United States Patent [19]

Wyckoff et al.

[11] Patent Number: 4,740,875

[45] Date of Patent: Apr. 26, 1988

[54] MOTOR VEHICLE HEADLIGHT HAVING LENS WITH GLARE PREVENTION MEANS

[75] Inventors: Peter N. Wyckoff, Newmarket, N.H.; George J. English, No. Reading, Mass.

[73] Assignee: GTE Products Corporation, Danvers, Mass.

[21] Appl. No.: 46,612

[22] Filed: May 7, 1987

[51] Int. Cl.[4] ..... F21V 7/00; F21V 29/00

[52] U.S. Cl. ..... 362/336; 362/309; 362/351

[58] Field of Search ..... 362/309, 336, 338, 351, 362/361

[56] References Cited

U.S. PATENT DOCUMENTS

| | | | |
|---|---|---|---|
| 1,561,149 | 11/1925 | Gage | 362/317 |
| 2,051,327 | 8/1936 | Chalfont | 362/338 |
| 2,260,736 | 10/1941 | Benton | 362/338 |
| 2,277,563 | 3/1942 | Scott et al. | 362/309 |
| 2,279,103 | 4/1942 | Anklam | 362/309 |
| 2,568,494 | 9/1951 | Geissbuhler | 362/309 |
| 2,782,297 | 2/1957 | Geissbuhler et al. | 362/309 |
| 2,855,500 | 10/1958 | Holman | 362/351 |
| 3,784,861 | 1/1974 | Notelteirs et al. | 313/117 |
| 4,029,985 | 6/1977 | Rachel | 313/115 |
| 4,128,864 | 12/1978 | Brussee et al. | 362/336 |
| 4,142,229 | 2/1979 | Hulbert, Jr. | 362/338 |
| 4,288,713 | 9/1981 | Marlor | 313/117 |
| 4,480,296 | 10/1984 | Gagnon et al. | 362/80 |
| 4,563,730 | 1/1986 | Saito | 362/80 |
| 4,642,514 | 2/1987 | English et al. | 313/111 |
| 4,660,128 | 4/1987 | Bergin et al. | 362/61 |

*Primary Examiner*—George L. Walton

*Attorney, Agent, or Firm*—Lawrence R. Fraley

[57] ABSTRACT

A motor vehicle headlight which includes a reflector, a light source (e.g., tungsten halogen capsule) within the reflector and a lens secured across the reflector's forward opening and including thereon means for substantially preventing glare to an oncoming motorist during headlight operation. This preferred means for preventing glare comprises a quantity of masking material (e.g., an opaque coating containing a black pigment) located on the lower angular surfaces or portions thereof of a preselected number of lensing facets formed within an internal surface of the lens. Light is thus prevented from passing through these masked angular surfaces or portions thereof in a substantially upward direction from the headlight location, which passage could in turn cause said glare. In a specific embodiment, a small size headlight (e.g., having an overall height of only about two inches) is described, which, if used in combination with a similar small sized headlight, could be used to provide the low beam function or one-half of a total lighting assembly for use in the motor vehicle. Thus, a total of eight such small sized headlights would be used per vehicle.

16 Claims, 3 Drawing Sheets

MOTOR VEHICLE HEADLIGHT HAVING LENS WITH GLARE PREVENTION MEANS

TECHNICAL FIELD

The invention relates to motor vehicle headlights and particularly to such headlights which are designed to reduce glare.

BACKGROUND

Examples of headlights intended to provide glare reduction are illustrated in U.S. Pat. Nos. 1,561,149 (Gage), 2,260,736 (Benton) and 4,142,229 (Hulbert). While the teachings of the invention are applicable to such larger sized headlights as illustrated in these patents, it is to be understood that said teachings are also applicable to providing glare reduction in smaller sized headlights of the type recently developed by the assignee of this invention. Examples include those described and illustrated in U.S. Pat. No. 4,660,128 (Bergin et al) and in copending applications Ser. No. 840,271, entitled "Motor Vehicle Headlight Module" (Bergin et al) and Ser. No. 016,616, entitled "Motor Vehicle Headlight Module" (Haraden). As described therein, these modules form part of an overall headlight assembly having, typically, four such modules per assembly. Each assembly in turn is designed for being located on a respective side (e.g., front fender) of the designated motor vehicle utilizing same. Thus, two modules combine to provide either the low or high beam capability for each assembly. By the term headlight as used herein is thus meant to include larger sized headlights such as illustrated in the aforementioned patents as well as those more recently developed, smaller sized components occasionally referred to as modules and specifically designed to form part of a larger assembly including several such components. The aforementioned larger sized headlights are also typically referred to in the current art as 1A, 2A, 2B, 1C, 2C and 2D headlights, depending on the number required per vehicle and the corresponding capability (low or high beam or both) desired. Such headlights also include the more recently introduced replacement types wherein a lamp capsule and holder assembly is removably positioned within a reflector-lens assembly and sealed (e.g., using an "O-ring" seal) through the rear portion of the reflector. Such headlights have also been referred to in the art as type 9004 headlights.

Attempts to reduce glare in motor vehicle headlights have included the provision of a "zone plate" designed to block out large areas of the headlight's lens, including particularly almost the entire center section (see, i.e., the aforementioned No. 4,142,229), providing lens coatings which also block a large part of the lens center and adjacent, continuous rows of the lens' internal surfaces which extend therefrom (see, i.e., the aforementioned No. 2,260,736), incorporating a light-intercepting shield within the headlight (see, i.e., U.S. Pat. No. 4,029,985 to Rachel) and using a combined heat and light shield located on the internal surface of the lens in line with and adjacent the light source (see, i.e., U.S. Pat. No. 4,642,514 to English et al). While such efforts have proven somewhat successful, these have required blockage of relatively large sections of the lens (resulting in a corresponding reduction in light output), use of relatively complicated and time-consuming assembly techniques, and/or utilization of additional elements within the headlight assembly (possibly adversely affecting the assembly's interior components, i.e., reflecting surfaces).

The present invention defines a headlight wherein glare is substantially prevented in a relatively simple manner without significantly reducing the headlight's total output. The invention as defined is relatively easy to assemble, in turn representing a cost savings to the ultimate consumer. It is believed that such a headlight constitutes a significant advancement in the art.

DISCLOSURE OF THE INVENTION

It is a primary object of the invention to provide a motor vehicle headlight wherein glare is substantially prevented during operation thereof.

It is another object of the invention to provide such a headlight which can be produced in both a relatively inexpensive and facile manner.

These and other objects are achieved by one aspect of the invention wherein there is provided a motor vehicle headlight including a reflector, a light source located within the reflector, a lens secured to or forming part of the reflector and including a plurality of lensing facets located within an internal surface thereof, each of said lensing facets including a facing surface and an angular surface contiguous to the facing surface and oriented at a predetermined angle relative to the facing surface, and means for substantially preventing glare from the headlight during operation thereof, this means including a quantity of masking material located substantially only on a preselected number of the angular surfaces of the lensing facets or portions of these angular surfaces for preventing passage of light therethrough.

BRIEF DESCRIPTION DF THE DRAWINGS

Figure 1:
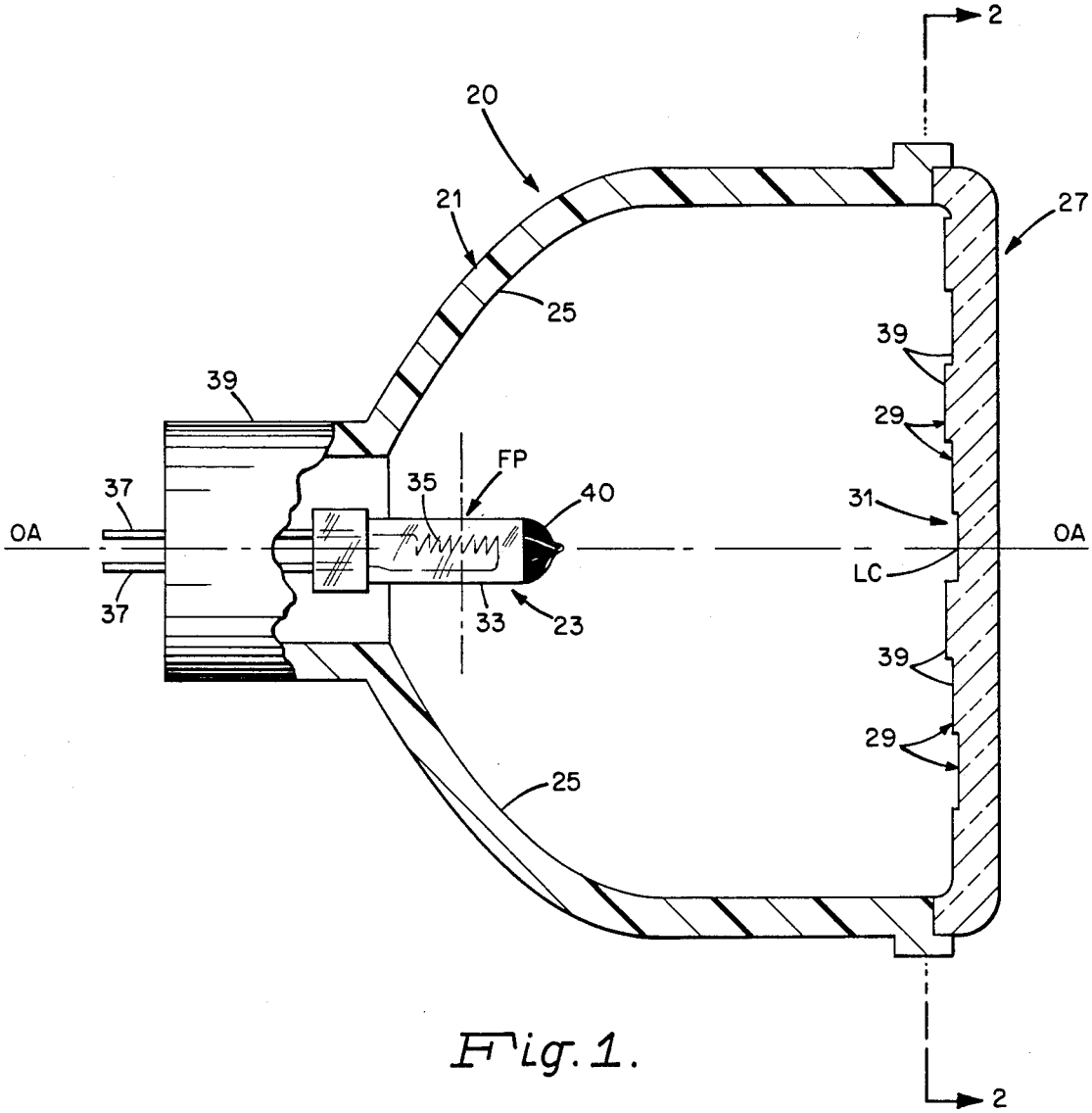
FIG. 1 is a side elevational view, in section, of a motor vehicle headlight in accordance with a preferred embodiment of the invention.
Figure 2:
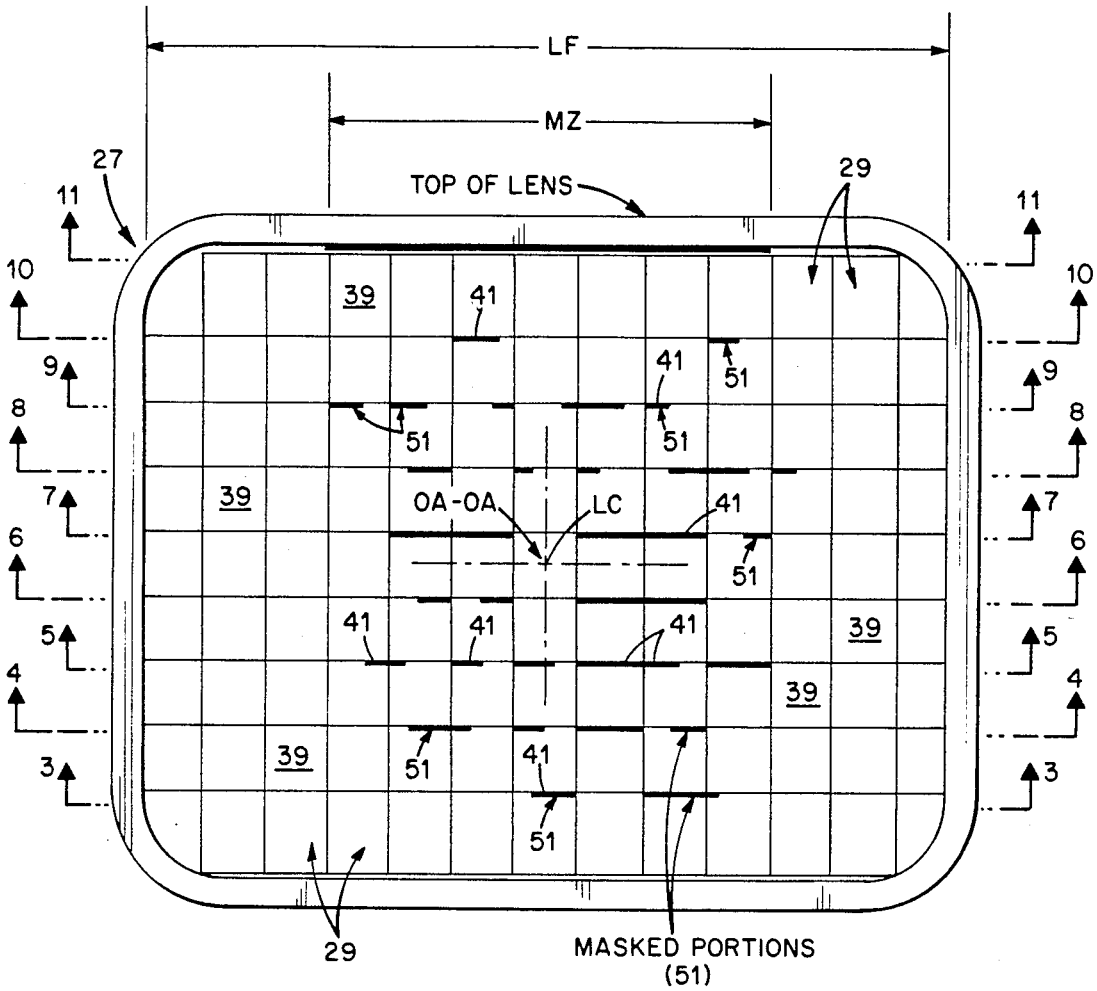
FIG. 2 is an elevational view, on an enlarged scale, of the headlight lens of FIG. 1 as taken along the line 2—2 therein (facing toward the front of the invention)
Figure 12:
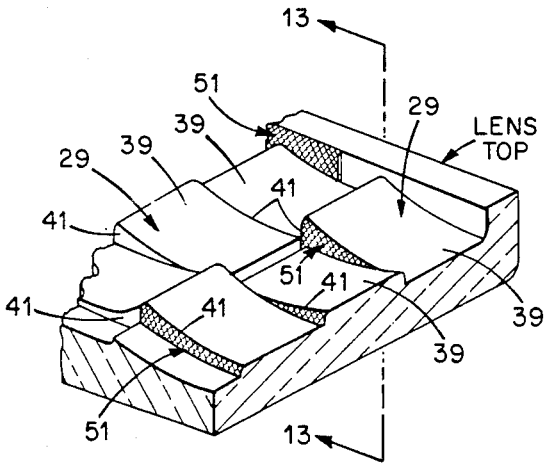
Figure 13:
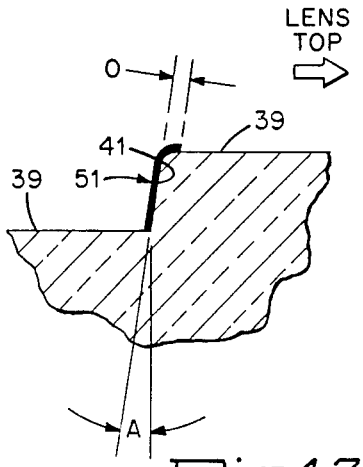
Figure 11:
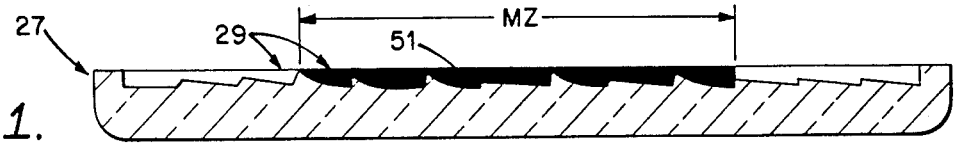
Figure 10:
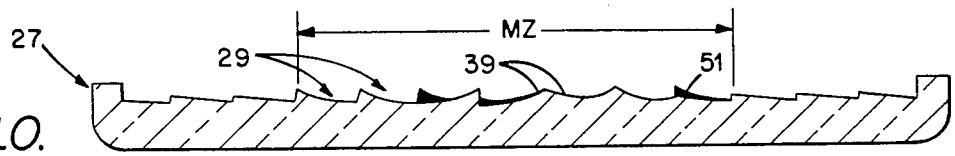
Figure 9:
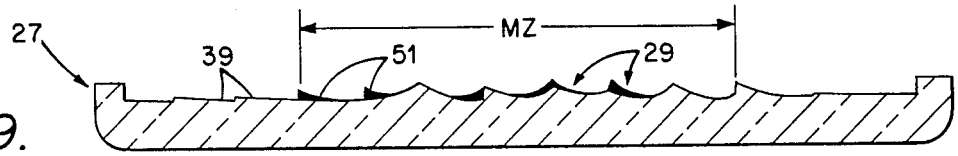
Figure 8:
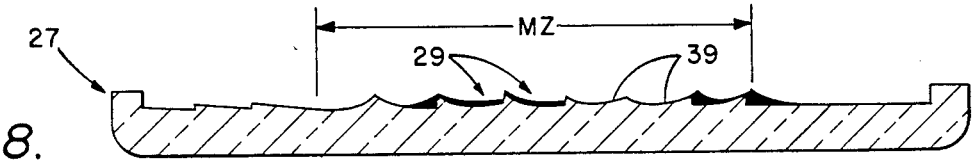
Figure 7:
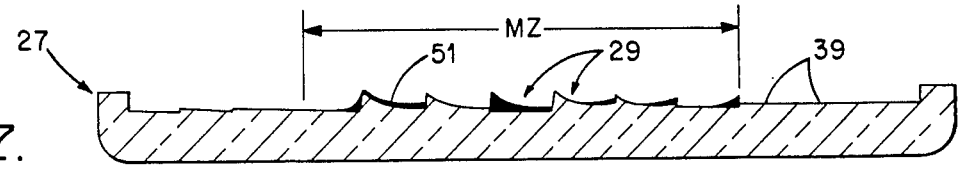
Figure 6:
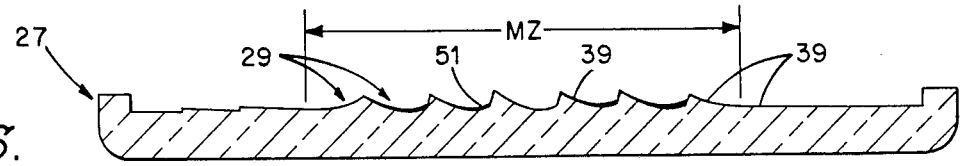
Figure 5:
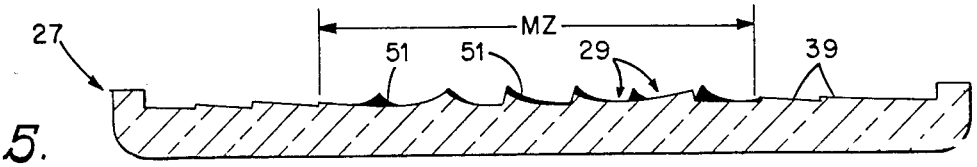
Figure 4:
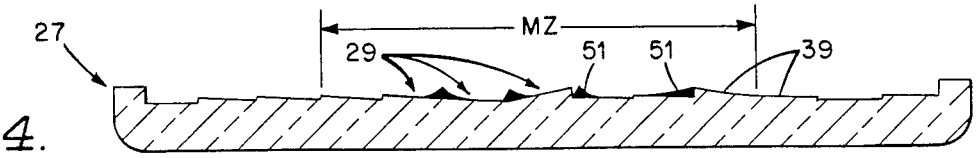
Figure 3:
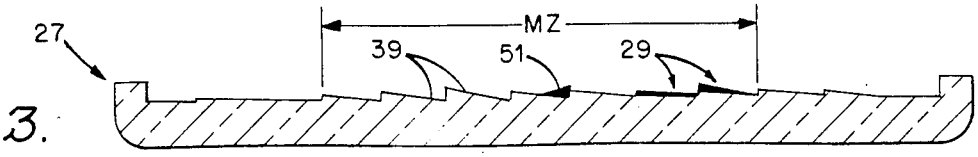

FIGS. 3—11 represent sectional views of the reflector of FIGS. 1 and 2, as taken along lines 3—3 through 11—11, respectively;

FIG. 12 is a perspective view, in section, of a small portion of a headlight lens to better illustrate various configurations the lensing facet of the invention may assume as well as how said facets may be masked in accordance with the teachings herein; and FIG. 13 is an enlarged, partial view of parts of two adjacent facets as may be utilized in the lens of the invention, illustrating the preferred location for the invention's masking material thereon.

BEST MODE FOR CARRYING OUT THE INVENTIDN

For a better understanding of the present invention together with other and further objects, advantages and capabilities thereof, reference is made to the following disclosure and appended claims in connection with the above-described drawings.

In FIG. 1, there is shown a motor vehicle headlight 20 in accordance with a preferred embodiment of the invention. Headlight 20 includes a reflector 21, a light source 23 located within reflector 21 and substantially surrounded by the internal reflecting surfaces 25 thereof, and a lens 27 secured to or forming part of reflector 21 and including therein a plurality of lensing facets 29 located within an internal surface of the lens so as to substantially face the contained light source 23.

Reflector 21 is preferably comprised of a high temperature, impact resistance plastic (i.e., a polycarbonate) but may also be comprised of glass (i.e., borosilicate). The reflector's internal reflecting surfaces 25 are preferably of a substantially parabolic configuration, as is known in the art. These surfaces are preferably formed by providing a reflective coating (i.e., aluminum) on the internal walls of the reflector. Should reflector 21 be utilized in one of the aforementioned modules, it preferably also includes a forward opening 31 of substantially rectangular configuration having an overall height of only about two inches. Under such circumstances, lens 27 is also preferably of glass and secured to opening 31 using a suitable adhesive known in the art. It is also within the scope of the invention, however, to utilize the aforementioned plastic material for lens 27. In either case, lens 27 preferably possesses an overall height of only about two inches should this component be used as part of the aforementioned module assembly. It is again understood, however, that the teachings of the invention are not limited merely to smaller sized headlight modules but are also clearly applicable to the aforementioned earlier, larger size headlights wherein internal lensing is desired.

The preferred light source 23 for headlight 20 is a tungsten halogen capsule having a hardglass (i.e., borosilicate) envelope 33 and a coiled-coil tungsten filament 35 therein. A pair of lead-conductors 37 extend from envelope 33 and are electrically coupled to filament 35. In the embodiment of FIG. 1, these conductors are shown as being located within the rear, neck portion 39 of reflector 21. Examples of suitable light sources for use in the invention include those of the low wattage variety (e.g., having a wattage within the range of about 15 to 25 watts) as defined in the aforementioned copending applications. Should headlight 20 be of the larger variety, a correspondingly larger capsule is preferably used. Capsule 23, as shown in FIG. 1, also preferably includes an opaque coating 40 located on the tip portion thereof. Examples of such a coating acceptable for use herein are defined in U.S. Pat. Nos. 4,288,713 (Marlor) and 3,784,861 (Notelteirs et al). Capsule 23 is oriented within reflector 21 such that the coiled filament 35 is centrally located at the reflector's focal point (FP). As such, light source 23 is oriented such that the tip portion of the capsule is pointed toward the reflector's forward opening 31. In this smaller version of the invention (a low wattage capsule in a reflector-lens assembly having an overall forward height of onlv about two inches), reflector 21 possessed a focal length within the range of only about 0.3 inch to about 0.5 inch. This dimension is understood to be the distance from the focal point (FP) to the rear reflective surface(s) 25 as measured along the optical axis (OA—OA).

In FIG. 2, a more detailed view of lens 27 in accordance with a preferred embodiment of the invention is shown. Lens 27 includes the aforementioned plurality of individual lensing elements 29 arranged in a predetermined number (i.e., nine) of horizontal, contiguous rows across the internal surface of the reflector. Except for those facets located within the slightly rounded four corners of the planar reflector, the remaining facets 29 each include a facing lensing surface 39 which, when viewed as in the direction of FIG. 2, are of uniform size. Only a representative few of the facets in FIG. 2 and corresponding facing surfaces are represented by the numerals 29 and 39, respectively. In one example, each of the facing surfaces 39, when viewed as in FIG. 2, possessed an overall width of about 0.188 inch and a corresponding similar height. Bearing such dimensions in mind, it must be emphasized that the facing surfaces 39 of a selected number (i.e., those located within the substantially central portion of lens 27) are curvilinear in shape and possess an overall depth substantially greater than those in other portions (i.e., the outermost side portions) of reflector 27. Examples of such curvilinear surfaces are better illustrated in the representative example in FIG. 12. Still another example of these comparative shapes can be found in the sectional views provided in FIGS. 3–11. As illustrated therein, those located toward the central portion (MZ) of lens 27 project substantially higher than those outside the central portion. The reason for this is that it has been determined that greater lensing is required within the central portion of the lens to provide the required pattern of illumination (see below). In other terms, greater light control is required at this central portion of the lens. As also shown in FIGS. 3–11, the remaining facets 29 within lens 21 possess a facing surface of substantially flat configuration. Typically, these may include not only those in the outermost, side portions of the lens, but also selected facets within the central portion. Determination of the ultimate configuration for the facing surfaces of facets 29 was accomplished by investigating the refraction desired of discreet coil images to form a required beam. The real coil images arriving at the central portion of the lens are larger than those about the perimeter and must be refracted to a greater extent for appropriate beam control.

Each of the lensing facets 29 of lens 27 includes the aforementioned facing surface, whether of curvilinear or substantially flat configuration, in addition to at least one angular surface 41 (see also FIG. 13) contiguous the respective facing surface 39 and oriented at a predetermined angle relative thereto. In one example, this preferred angle (A in FIG. 13) was from about 0 degrees to about 20 degrees from normal to the facing surface. That is, angular surface 41 thus forms an angle within the range of from about 90 degrees to about 110 degrees to this surface. In a specific embodiment. this angular surface formed an angle of about 100 degrees.

As stated, all of the facets within lens 27 preferably include one of the aforementioned angular surfaces contiguous to the respective facing surface of each facet. Depending on the lens function required for each facet, however, this angular surface will range in depth and may be located only along the bottom (lower edge) of the facet, along only the top (or upper edge) of the facet, or, in some instances, along both upper and lower edges. The specific configuration depends on the corresponding shape of the adjacent facets, as determined by the lensing function required of each. As clearly seen in FIGS. 3–11, those facets located in the outermost side portions of the reflector include minimum (very small) angular surfaces while those of preselected facets within the reflector's central portion (MZ) require an angular surface of substantially greater size. The configurations illustrated in FIG. 12 are thus meant to be representative of such surfaces as may be utilized in the instant invention. It is clearly within the scope of the invention to utilize other configurations. It should also be added that the particular facet configurations illustrated in the sectional views of FIGS. 3–11 are not meant to limit the scope of the invention as defined herein. That is, other configurations are acceptable in order to provide the desired light output for headlight 20. The configurations illustrated have proven to be particularly successful when employed in a lens and reflector combination possessing the small sizes (i.e., a height of only about two inches) mentioned herein. Thus for lens members of substantially greater overall height and width, a different pattern of facet configurations would be utilized.

With particular attention to FIG. 2 and to the sectional views of FIGS. 3–11, there is illustrated the preferred means for substantially preventing glare from headlight 20. This glare prevention means is shown therein as including a quantity of masking material 51 strategically located on at least portions of the lower angular surfaces 41 of a preselected number of lensing facets 29 within lens 27. As shown, this masking material 51 is located on only the angular surfaces 41 or portions thereof of those facets which are believed to contribute significantly to causing glare to an oncoming motorist during operation of headlight 20. Such facets, as shown, cccupy substantially the central portion MZ of the entire lensing field LF of the planar, rectangular lens. Surprisingly, glare prevention was substantially provided by such strategic placement of masking material on only the lower angular surfaces (as illustrated) and, equally significant, on only those surfaces substantially within the central portion MZ. It was not necessary in order to accomplish the desired results of the invention to mask the facing surfaces 39 (or large portions thereof), which masking would result in the blockage of substantial quantities of direct light through lens 27. As defined herein, glare prevention is substantially provided without the necessity of doing this while still assuring optimum output for headlight 20. Masking of the lower angular surfaces serves to prevent light passing therethrough, which light would be directed in a substantially upward direction from the lens as vertically oriented in the designated motor vehicle.

By the term masking as used herein is meant to prevent light passage through the preselected areas so covered. The preferred masking material thus comprises an opaque coating which, in one embodiment included a black pigment. Suitable examples of masking material for use on lens 27 include an epoxy-based black paint currently available from the Markem Corporation, Keene, NH and sold under the product number 4405. This material is capable of withstanding operating temperatures of about 400 degrees Fahrenheit and can be heat cured after application in relatively short periods of time. By way of example, this material was applied to a quantity of lenses and heat cured at 350 degrees Fahrenheit in 15 minutes. Lower temperatures can be utilized with a corresponding longer cure period. Alternatively, the opaque coatings defined in the aforementioned U.S. Pat. Nos. 4,288,713 and 3,784,861 could be successfully utilized. The teachings of these patents are thus incorporated herein by reference.

The preferred technique for applying the invention's masking material 51 (i.e., the aforementioned black paint) involved utilization of a gravure plate, transfer printer and elastomer pad. The pad being of ribbed configuration, is selectively coated with the material and swung into contact with the positioned lens. The lens, when so contacted (and coated) is preferably horizontally positioned with the lensing surfaces facing upward. Once coated, the lens (and coating) is heated (and cured) at the parameters mentioned above.

With particular attention to FIGS. 12 and 13, a more detailed example of the relative location of masking material 51 is shown. As indicated by these representative examples, masking material 51 is located only on the lower angular surfaces 41 of the selected facets to substantially cover those portions of such surfaces exposed when viewed from the lens bottom. As also understood, not all of such lower surfaces 41 are covered, but only those forming part of the preselected number of lensing facets which are deemed to significantly contribute to glare. These facets, and their corresponding angular surfaces, are clearly illustrated in the sectional views of FIGS. 3–11 as taken through the nine horizontal rows depicted in FIG. 2.

As stated, FIG. 13 is an enlarged, representative view illustrating by way of example the positioning of masking material 51 on a respective one of the angular surfaces 41 as may be found in the lens of the invention. As shown, masking material 51 occupies the entire length of the flat angular surface 41 and, in the event that this surface is slightly curved (as indicated), overlaps a predetermined amount (dimension 0) onto the facing surface 39. Such overlap is only deemed necessary when lens facets having such rounded contours are provided. In the aforementioned example, an overlap of only about 0.005 inch to about 0.01 inch was employed. Therefore, the term substantially only on the illustrated lower angular surfaces is meant to include the situations wherein such slight overlapping onto the facing surfaces occurs. That is, this language is meant to include the provision wherein minor, relatively insignificant portions (in this case, from only about two percent to about five percent) of the total area of the respective facing surface is covered. Again, this is not necessary for lenses wherein the respective facets can be produced having sharp, well defined edges.

In the aforementioned example (the rectangular lens depicted in FIG. 2), the described masking was provided on about thirty percent of the total number of facets used in the lens. That is, such masking occupied the lower angular surfaces or portions thereof of 35 of the total number (117) of facets formed within the lens. Depending on the total number of lensing facets used, the preferred number of such facets having masking material thereon comprises from about twenty to about forty percent of the total number of facets. Such facets will in turn occupy substantially the central portion MZ of the lens in a predetermined pattern about the lens center LC (FIG. 2). As understood, the optical axis OA—OA of reflector 21 passes through this lens center LC when the lens is secured to the reflector in the manner depicted in FIG. 1.

The following Table I represents intensity values obtained at designated Society for Automotive Engineers (hereinafter SAE) test points as measured from a headlight possessing a masked lens as defined above. Table I also includes values obtained for a comparative unmasked headlight over the same range. These SAE points correspond to those in the following Table II which in turn indicate the respective location for these photometric values as required by the SAE. Attention is directed to the above U.S. Pat No. 4,142,229 (i.e., column 4, lines 47–59) for an explanation of how these test points may be arranged. Such orientations are also known in the art and further description is not believed necessary. These specifications vary according to the headlight system utilized. For example, the values stipulated in Table I are similar to those promulgated by the Department of Transportation (hereinafter OOT) for type F headlight systems wherein two lamps are utilized per side of the respective motor vehicle. Thus, a total of four rectangular sealed beam lamps are used in such a system. In the case of the aforementioned, smaller versions of the instant invention, however, wherein the defined two inch high headlight modules are used, these values are approximately one-half those required for said system. This is due to the fact that, as stated, two such modules are utilized for each beam (low or high) function required. That is, the point values stipulated in Table I must be doubled in order to meet the required SAE photometric specifications for a type F headlight. Because the smaller sized headlight module as described by example herein is used in combination with a similar module (also having masking thereon), the values produced in Table I clearly show that two such similar modules, if combined, will result in a total output capable of satisfying these requirements. Described measurements of the light produced from the invention as defined above were taken at a prescribed distance from the lamp, said measurements taken from a large screen (not shown) located at this distance. Standard measuring procedures as defined by the SAE and which are known in the art were utilized. As also understood from the following tables, measurements were only taken along predetermined SAE photometric test points determined to represent those locations wherein intensity values capable of significantly contributing to glare were evident.

TABLE I

| SAE Photometric Points Test | 4 | 5 | 6 | 7 | 8 | 9 | 10 | 11 | 12 |
|---|---|---|---|---|---|---|---|---|---|
| Required Intensity (candelas) | 1500 (max) | 500 (max) | 350 (max) | 1350 (max) | 700 (max) | 5000 (min) | 7500 (min) | 1350 (max) | 1350 (max) |
| Masked Intensity (Candelas) | 1000 | 443 | 314 | 1093 | 375 | 5750 | 10875 | 1162 | 881 |
| Unmasked Intensity (Candelas) | 1025 | 487 | 370 | 1125 | 431 | 6062 | 12000 | 1156 | 894 |

TABLE II

| SAE Photometric Test Point | Test Point (Degrees)* |
|---|---|
| 4 | ½D - 1½L to L |
| 5 | ½U - 1½L to L |
| 6 | 1U - 1½L to L |
| 7 | ½U - 1R |
| 8 | 1½U - 1R to R |
| 9 | ½D - 1½R |
| 10 | 1½D - 2R |
| 11 | ½U - 2R |
| 12 | ½U - 3R |

*± ¼ degree

In the above example, the headlight lens also included a circumferential edge portion (shown partially in FIG. 12 and in total in FIG. 2) about the outermost part thereof. This edge protrudes only slightly above the uppermost surfaces of the internally positioned lensing elements. In the embodiment of the invention which provided the output defined in Table I, the top edge portion of the lens also included a quantity of masking material 51 along a part thereof which corresponded to the lower central part (MZ) of lens 27 which contained the masked. angular surfaces 41. This coating is clearlv illustrated in FIGS. 2 and 11, and partly represented in FIG. 12. Thus, light from source 23 was also prevented from passing through this internal edge (which is substantially perpendicular to the plane of lens 27) to provide the results in Table I.

In summary, a headlight has been provided which substantially prevents glare to an oncoming motorist during operation thereof. As defined. this headlight mav be of the small sized variety as recently developed by the assignee of the instant invention and thus which is capable of being used in combination with other, similar such smaller headlights to provide the overall headlight function for an automobile utilizing these. By way of example, a total of four such small sized headlights may be used per side of the vehicle, with two of such elements providing the low beam function and the other two providing the high beam function. A total of eight such components would be utilized per motor vehicle. It is also understood that the teachings of the instant invention are not limited to such small sized headlight components. It is thus within the scope of the invention to utilize the unique teachings as provided herein in headlamps of much larger size, including the aforementioned sealed beam and replaceable types currently used in many of today's motor vehicles.

While there have shown and described what are present considered the preferred embodiments of the invention, it will be obvious to those skilled in the art that various changes and modifications will be made therein without departing from the scope of the invention as defined by the appended claims.

What is claimed is:

1. A motor vehicle headlight comprising:

a reflector;

a light source located within said reflector;

a lens secured to or forming part of said reflector and including a plurality of lensing facets located within an internal surface thereof, each of said lensing facets including a facing surface substantially directed toward said light source and an angular surface contiguous said facing surface and oriented at a predetermined angle relative to said facing surface; and means for substantially preventing glare from said headlight during operation thereof, said means including a quantity of masking material located substantially only on a preselected number comprising less than the total of said angular surfaces of said lensing facets or portions of said angular surfaces for preventing passage of light therethrough, whereby said facet facing surfaces are free of masking material to allow passage of substantial quantities of direct light through said lens.

2. The headlight of claim 1 wherein said lens is comprised of glass.

3. The headlight of claim 2 wherein said reflector is comprised of plastic, said lens being secured thereto.

4. The headlight of claim 1 wherein said light source comprises a tungsten halogen capsule having a coiled tungsten filament therein.

5. The headlight of claim 1 wherein said masking material comprises an opaque coating.

6. The headlight of claim 5 wherein said coating is comprised of a black pigment.

7. The headlight of claim 1 wherein said predetermined angle of each of said angular surfaces having said masking material thereon is within the range of from about 90 degrees to about 110 degrees.

8. The headlight of claim 7 wherein said predetermined angle is about 100 degrees.

9. The headlight of claim 1 wherein said angular surfaces or portions thereof of said preselected number of said lensing facets having said masking material thereon comprise lower surfaces of said facets when said lens is located in a substantially vertical orientation during said module operation.

10. The headlight of claim 9 wherein said angular surfaces or portions thereof are substantially centrally disposed within said lens.

11. The headlight of claim 9 wherein said quantity of masking material on each of said angular surfaces or portions thereof overlaps slightly onto said facing surface.

12. The headlight of claim 9 wherein each of said facing surfaces of said lensing facets are of a substantially uniform size.

13. The headlight according to claim 12 wherein said preselected number of said lensing facets having said angular surfaces or portions thereof having said masking material thereon comprises from about 20 percent to about 40 percent of the total number of said lensing facets.

14. The headlight of claim 9 wherein said lens is of substantially planar configuration and said reflector is of a substantially parabolic configuration and has a focal length within the range of about 0.2 inch to about 0.5 inch, said lens having an overall height of only about 2.0 inches.

15. The headlight of claim 9 wherein said lens further includes a top edge portion, said top edge portion also including a quantity of said masking material on at least a portion thereof.

16. The headlight of claim 1 wherein said preselected number of said angular surfaces of said lensing facets is in the area of twenty percent to forty percent of the total number of facets.

* * * * *